US010480349B2

(12) United States Patent
Lucas et al.

(10) Patent No.: US 10,480,349 B2
(45) Date of Patent: Nov. 19, 2019

(54) SYSTEM AND METHOD FOR DISTRIBUTING AND CONTROLLING OIL FLOW

(71) Applicant: BorgWarner Inc., Auburn Hills, MI (US)

(72) Inventors: Evan Lucas, Marshall, NC (US); Jason P. Moscetti, Hendersonville, NC (US); Christian Longacre, Arden, NC (US)

(73) Assignee: BorgWarner Inc., Auburn Hills, MI (US)

( * ) Notice: Subject to any disclaimer, the term of this patent is extended or adjusted under 35 U.S.C. 154(b) by 109 days.

(21) Appl. No.: 15/564,074

(22) PCT Filed: Apr. 4, 2016

(86) PCT No.: PCT/US2016/025841

§ 371 (c)(1),
(2) Date: Oct. 3, 2017

(87) PCT Pub. No.: WO2016/164297

PCT Pub. Date: Oct. 13, 2016

(65) Prior Publication Data

US 2018/0094542 A1 Apr. 5, 2018

Related U.S. Application Data

(60) Provisional application No. 62/145,691, filed on Apr. 10, 2015.

(51) Int. Cl.

| | |
|---|---|
| ***F01D 25/18*** | (2006.01) |
| ***F02B 37/00*** | (2006.01) |
| ***F02B 39/14*** | (2006.01) |

(52) U.S. Cl.

CPC ..... *F01D 25/18* (2013.01); *F02B 39/14* (2013.01); *F02B 37/00* (2013.01); *F05D 2220/40* (2013.01)

(58) Field of Classification Search

CPC .. F01D 25/16; F01D 25/18; F02C 6/12; F01C 7/06; F02B 39/14; F02B 37/00; F05D 2220/40

(Continued)

(56) References Cited

U.S. PATENT DOCUMENTS 2,886,133 A * 5/1959 Mauck ..... F01D 25/18 184/6.26
3,057,436 A * 10/1962 Jacobson ..... F01D 25/20 123/196 A (Continued)

FOREIGN PATENT DOCUMENTS

CN 103375259 A 10/2013
JP 08014057 A 1/1996

(Continued)

OTHER PUBLICATIONS

International Search Report and Written Opinion; dated Jun. 29, 2016; for International Application No. PCT/US2016/025841; 11 pages.

(Continued)

*Primary Examiner* — Patrick D Maines
*Assistant Examiner* — Dapinder Singh
(74) *Attorney, Agent, or Firm* — BrooksGroup

(57) ABSTRACT

An exhaust gas turbocharger (10) including a turbine section (14), a compressor section (12), a bearing housing (16) disposed between an fluidly connected to the turbine section (14) and the compressor section (12), and an oil flow means connected to the bearing housing (16) for controlling and metering oil flow to the bearing assembly (42).

11 Claims, 4 Drawing Sheets

(58) Field of Classification Search
USPC ..... 60/605.3
See application file for complete search history.

(56) References Cited

U.S. PATENT DOCUMENTS 3,420,434 A * 1/1969 Swearingen ..... F01D 11/04 277/412
3,728,857 A * 4/1973 Nichols ..... F01D 11/04 184/6.11
3,895,689 A * 7/1975 Swearingen ..... F01D 25/168 184/6.4
4,058,981 A * 11/1977 Henson ..... F01M 1/02 184/6.3
4,285,632 A * 8/1981 DeSalve ..... F01D 25/18 184/6.11
4,798,523 A * 1/1989 Glaser ..... F01D 25/16 184/6.16
4,945,933 A * 8/1990 Krajicek ..... B05B 3/02 134/167 R
5,735,676 A * 4/1998 Loos ..... F01D 25/18 184/104.1
7,010,916 B2 * 3/2006 Sumser ..... F01D 11/02 415/114
7,912,620 B2 * 3/2011 French ..... F01M 1/16 123/196 S
8,353,158 B2 * 1/2013 Purdey ..... F01D 25/166 415/110
8,739,528 B2 * 6/2014 Shiraishi ..... F01D 25/18 417/407
9,062,595 B2 * 6/2015 Jones ..... F02B 39/14
2010/0114454 A1 * 5/2010 French ..... F01M 1/16 701/102
2013/0136579 A1 * 5/2013 Koch ..... F01D 25/18 415/115
2013/0280032 A1 10/2013 Stump et al.
2014/0326225 A1 * 11/2014 Shioda ..... F02C 6/12 123/559.1
2016/0040591 A1 * 2/2016 Koyanagi ..... F01D 25/166 415/111
2017/0342998 A1 * 11/2017 Uneura ..... F16C 33/1065
2018/0003105 A1 * 1/2018 Kojima ..... F01D 25/16

FOREIGN PATENT DOCUMENTS

JP 2009243365 A 10/2009
JP 2014199050 A 10/2014
KR 100388200 B1 6/2003

OTHER PUBLICATIONS

Chinese Office Action dated Feb. 28, 2019; Application No. 201680020963.5; Applicant: BorgWarner Inc.; 14 pages.

* cited by examiner

SYSTEM AND METHOD FOR DISTRIBUTING AND CONTROLLING OIL FLOW

CROSS-REFERENCE TO RELATED APPLICATION

This application claims priority to and all the benefits of U.S. Provisional Application No. 62/145,691, filed on Apr. 10, 2015, and entitled "System And Method For Distributing And Controlling Oil Flow"

FIELD OF THE DISCLOSURE

This invention is directed to a turbocharging system for an internal combustion engine and more particularly to a system and method for distributing oil flow to journal and thrust bearings to improve overall turbocharger performance, where oil flow is actively metered using an oil flow control device.

BACKGROUND

A turbocharger is a type of forced induction system used with internal combustion engines. Turbochargers deliver compressed air to an engine intake, allowing more fuel to be combusted, thus boosting the horsepower of the engine without significantly increasing engine weight. Thus, turbochargers permit the use of smaller engines that develop the same amount of horsepower as larger, normally aspirated engines. Using a smaller engine in a vehicle has the desired effect of decreasing the mass of the vehicle, increasing performance, and enhancing fuel economy. Moreover, the use of turbochargers permits more complete combustion of the fuel delivered to the engine, which contributes to the highly desirable goal of a cleaner environment.

Turbochargers typically include a turbine housing connected to the exhaust manifold of the engine, a compressor housing connected to the intake manifold of the engine, and a center or bearing housing disposed between and coupling the turbine and compressor housings together. The turbine housing defines a generally annular chamber, consisting of a scroll or volute, which surrounds the turbine wheel and receives exhaust gas from an exhaust supply flow channel leading from the exhaust manifold of the engine. The turbine housing generally includes a nozzle that leads from the generally annular chamber, consisting of the scroll or volute, into the turbine wheel. The turbine wheel, in the turbine housing, is rotatably driven by an inflow of exhaust gas supplied from the exhaust manifold. A shaft rotatably supported in the center or bearing housing connects the turbine wheel to a compressor impeller in the compressor housing so that rotation of the turbine wheel causes rotation of the compressor impeller. The shaft connecting the turbine wheel and the compressor impeller, defines a line which is the axis of rotation.

Exhaust gas flows into the generally annular turbine chamber, consisting of the scroll or volute, through the nozzle, to the turbine wheel, where the turbine wheel is driven by the exhaust gas. The turbine wheel spins at extremely high speeds and temperatures. As the turbine wheel spins, the turbine extracts power from the exhaust gas to drive the compressor. The compressor receives ambient air through an inlet of the compressor housing and the ambient air is compressed by the compressor wheel and is then discharged from the compressor housing to the engine air intake. Rotation of the compressor impeller increases the air mass flow rate, airflow density and air pressure delivered to the cylinders of the engine via the engine intake manifold thus boosting an output of the engine, providing high engine performance, reducing fuel consumption, and environmental pollutants by reducing carbon dioxide ($CO_2$) emissions.

The turbocharger center or bearing housing includes a bearing system that is used to support the shaft and keep the shaft spinning freely. The bearing system also aids in resisting radial and thrust loads created by the compressor and turbine wheels. Thrust loading is created by pressure differentials between the compressor and turbine housings. Thrust loads are imposed along the axis of the shaft and tend to push the shaft back and forth. Radial loads act perpendicularly to the axis of the shaft and are a cause of the back and forth shaft motion. A bearing system commonly used in turbochargers, typically consists of a journal bearing assembly that are cylindrical bearings which contain the radial loads and a thrust bearing assembly that is generally a flat circular disk which manages the thrust loads. Oil is used to keep rotating parts of the turbocharger from rubbing, preventing metal-to-metal contact, and decreasing friction. Each end of the shaft is sealed, at a location at which the shaft passes through the bearing housing, in order to limit contact between the bearing lubricant and the gas. If lubricant is allowed to leak into the hot gas path, it can vaporize and burn, causing the creation of harmful soot and increased emissions.

In order to properly lubricate the turbocharger and rotating parts, a reliable and clean supply of oil must be provided. If the oil supply is insufficient, drops too low, or becomes contaminated with debris, the bearing system operating temperatures are drastically increased, severely diminishing the hearing system lifetime, creating an environment where it is highly likely that the turbocharger may become damaged and may ultimately fail. However, excessive oil flow can result in increased oil leakage through the turbocharger shaft and seals. The flow of air and oil crossing the seals of the turbocharger can be a significant source of inefficiency, and in severe cases destructive to the operation of the turbocharger and engine air system.

SUMMARY OF THE INVENTION

In some aspects, the system for distributing oil flow includes a turbocharger bearing housing, an oil inlet, and air channel, an oil channel, and a valve assembly. The oil inlet is connected to the air channel and the oil channel. The oil channel directs a flow of oil to the thrust and journal bearings. Oil flow to components of the bearing housing may be limited by the valve assembly. The valve assembly is operated using mechanical linkages and actuators. The valve assembly may be specifically manipulated to boost pressure, compressor pressure ratio, turbine speed, engine control unit (ECU) data, engine condition, and/or any variation of these characteristics.

In some aspects, the valve assembly can be integrated into the bearing housing and may function to limit oil flow to the journal bearings and/or the thrust bearings. The valve assembly may include a variable position valve having a valve member with a stop positioned at a first end and a throughport and spring positioned at a second end. The variable position valve may include any type of variable position valves such as globe, needle, gate or rotary valves.

In some aspects, the variable position valve is controlled by the pressure behind the compressor wheel. The pressure from behind the compressor wheel is transmitted to the variable position valve through the air channel. Air pressure through the air channel moves the valve member. Movement of the valve member is resisted by the spring. The stop determines the minimum amount of flow through the through-port. The stop also functions to encapsulate and externally seal the valve assembly. The spring may be a conical spring, an air spring, or any spring device that would alter the stiffness of the valve member while allowing for a prescribed amount of displacement of the valve member.

The valve assembly may be connected to a pneumatic actuator or hydraulic actuator. The pneumatic actuator or hydraulic actuator would be connected to the compressor such as at the compressor outlet or behind the compressor wheel. At low compressor pressures, the oil channel to the thrust bearing would be restricted by the valve assembly. At high pressures, flow through the oil channel would be fully open, without restriction from the valve assembly.

In some aspects, the valve assembly may be controlled electronically. Instead of using springs, an electronic actuator can be connected directly to the piston. Electronic actuators can factor in the rotational speed of the turbocharger to balance the optimal performance of the bearing assemblies with minimal blow-by. Electronic actuators may also assist with preventing issues associated with start-up by throttling thrust bearing oil supply only after ignition.

Advantages of electronic actuators may include the ability to differentiate between a warm engine and an engine at cold-start. At cold-start, oil is more viscous than warm temperature oil. The elevated viscosity can reduce or delay oil flow to the bearing components causing premature wear. Hence, colder environments, such as during cold start, premature wear caused by reduced or delayed oil to bearing components is worsened. Electronic actuators can also account for the temperature of the engine and make the necessary adjustments by leaving the oil channel fully open during those conditions when the oil is not warm enough.

In some aspects, turbocharger oil flow is actively metered to the bearing housing based upon operating parameters such as oil temperature, compressor discharge pressure, and/or turbine inlet pressure. Similarly, the oil flow may also be metered using a pneumatic actuator, based upon turbocharger pressure differential (dP), which is the pressure difference between the turbine inlet pressure and the compressor discharge pressure. The turbine inlet pressure and compressor discharge pressure create an axial load on the shaft which is supported by an axial bearing. During engine idle scenarios, both the turbine inlet pressure and the compressor discharge pressure are low, subsequently generating a low axial bearing load. Little oil flow is required under low compressor discharge and low axial bearing load conditions. However, if the oil flow during engine idle is excessive, oil will leak beyond the shaft seals, causing emissions problems, and decreased engine durability and effective operation. The pneumatic actuator is coupled to an oil flow control device which permits the least amount of oil flow at a neutral turbocharger pressure differential (dP). Oil flow is adequately suppressed during engine idle or under operating conditions with a low turbocharger pressure differential (dP).

The oil flow control device would involve a retrofit design, where the oil flow control device replaces the conventional oil inlet fitting. As such, the oil flow control device may be positioned in-line with an existing turbocharger oil inlet. Other designs such as a permanent feature built into the turbocharger oil circuit or bearing housing may also be feasible.

The oil flow control device includes an actuating member and a throttle. The actuating member includes a rod having a piston at one end and a spherical valve disposed at an opposing end thereof. The throttle includes an oil-in passage and a shaped oil passage. The spherical valve includes a ball portion shaped to be positioned within a shaped oil passage formed in the throttle. The shaped oil passage can be an hourglass shape and the ball portion is sized to be able to engage a protruding or contoured portion of the shaped oil passage, thereby obstructing oil flow therethrough. While a spherical valve containing a ball portion and an hourglass shaped oil passage are feasible design options for the oil flow control device and oil passage, other designs are easily imagined. The spherical valve can operate uni-directionally or bi-directionally. In either instance, the spherical valve and hourglass shaped passage ensures that the oil flow increases as the absolute value of axial load increases.

Additionally, the actuating member of the oil flow control device includes a positive pressure chamber. The piston of the rod divides the positive pressure chamber into a first chamber and a second chamber. The first chamber includes a connection to the compressor discharge pressure and the second chamber includes a connection to the turbine inlet pressure. The actuating member moves upward and downward according to the pressure differentials (dP) between the upper and lower chambers.

The oil flow control device may also include return springs that aid in moving the spherical valve within the shaped oil passage. The clearance between the ball portion of the spherical valve and the shaped oil passage, the diameters of the passages, and the spring return rate can all be adjusted to accommodate various turbocharger applications.

In some aspects, particularly during non-idle scenarios, the load supported by the axial bearing and the oil flow associated therewith is proportional to the turbocharger pressure differential (dP) and the impeller diameters, which is a constant parameter. Under these operating parameters, more oil flow is provided to the turbocharger during high load conditions, and less oil flow is provided during low load conditions. The oil flow is governed by the absolute value of the displacement of the actuating member. Proficient oil flow control results in effective bearing operation at high load, and decreases parasitic losses that occur from excessive oil flow during low axial load conditions.

In some aspects, oil flow can be metered based upon oil inlet temperature. To do so, a simple thermostat can be added to the flow control valve assembly. During start up conditions, the thermostat would be open to maximize oil flow. The thermostat would close as oil inlet temperature increases, eliminating excessive oil flow at normal operating temperatures. The thermostat can be an additional feature, or could replace the pneumatic actuator.

While a pneumatic actuator has been described and proven to be effective, an electronic actuator, hydraulic actuator or other similar devices are also known to work well. An engine control module or a supplementary control module could be used to control actuation. An additional passage can also be included. The additional passage can be controlled by any other means such as a thermostat or a permanent bypass and would function to deliver a specified amount of oil at idle or during low axial load conditions.

In some aspects, the valve assembly can be used to control oil flow to a single bearing component in addition to or independent of the entire bearing assembly. Also, one or more valve assemblies can be used to control oil flow to a single bearing, multiple bearings, or the entire system. Moreover, the valve assembly and the oil flow control device can each be used alone or in combination with one another.

BRIEF DESCRIPTION OF THE FIGURES

The present disclosure is illustrated by way of example and should not be limited by the accompanied drawings in which like reference numbers indicate similar parts, and wherein.

DETAILED DESCRIPTION

Figure 1:
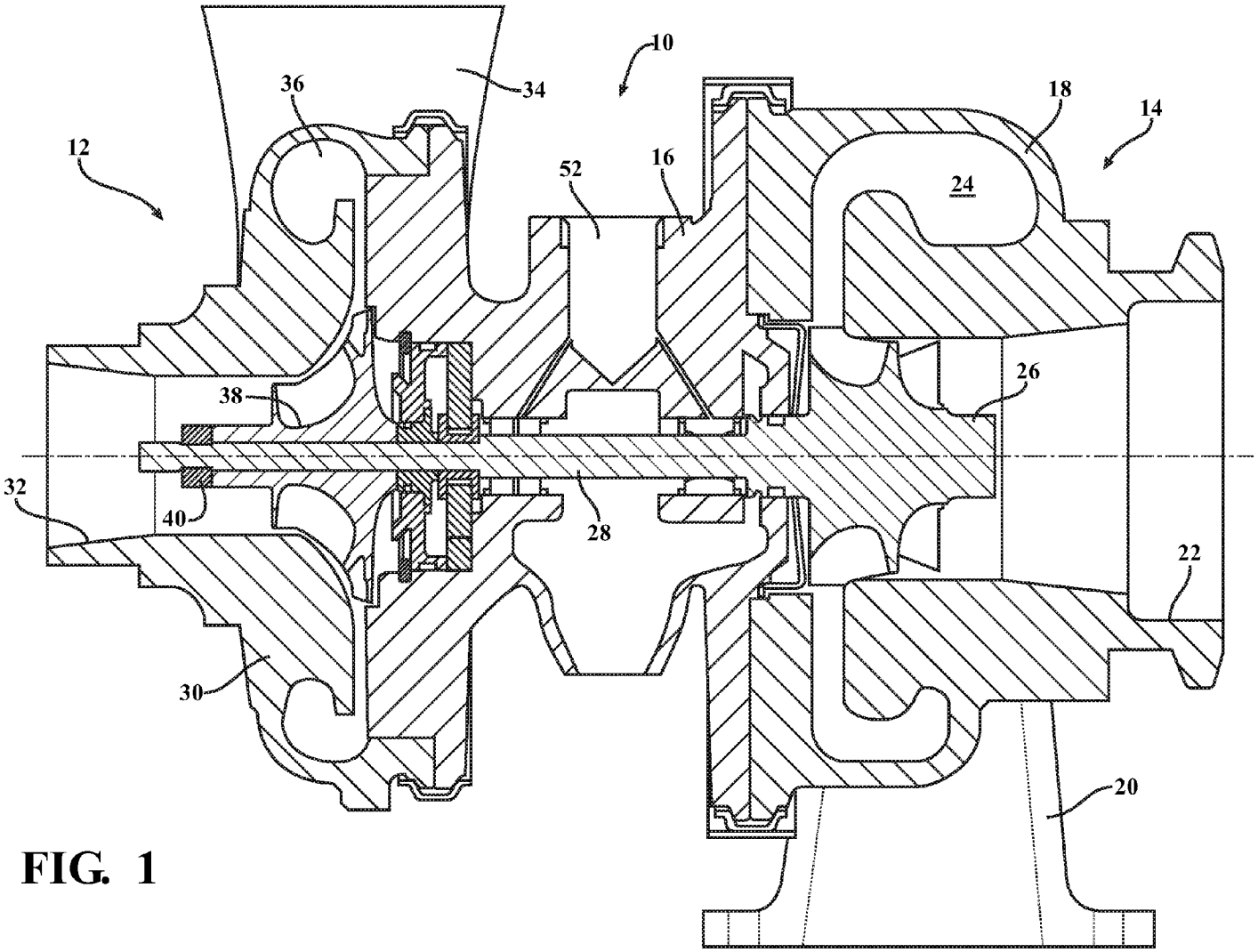
FIG. 1 is a cross-sectional view of an exhaust gas turbocharger.

FIG. 1 details an exhaust gas turbocharger (10) including a compressor section (12), a turbine section (14), and a bearing housing (16) disposed between and connecting the compressor section (12) to the turbine section (14). The turbine section (14) includes a turbine housing (18) that defines an exhaust gas inlet (20), an exhaust gas outlet (22), and a turbine volute (24) disposed in fluid communication with the exhaust gas inlet (20) and the exhaust gas outlet (22). A turbine wheel (26) is disposed in the turbine housing (18) between the volute (24) and the exhaust gas outlet (22). The turbine wheel (26) is fixed to a shaft (28). The shaft (28) is rotatably supported within the bearing housing (16), and extends into the compressor section (12). The compressor section (12) includes a compressor cover (30) that defines a compressor air inlet (32), a compressor air outlet (34), and a compressor volute (36). A compressor wheel (38) is disposed in the compressor cover (30) between the compressor air inlet (32) and the compressor volute (36). The compressor wheel (38) is disposed on an opposed end of the shaft (28), and secured thereto by a nut (40). The turbine wheel (26), the shaft (28) and the compressor wheel (38) are the main components of a rotating assembly of the turbocharger (10).

Figure 2:
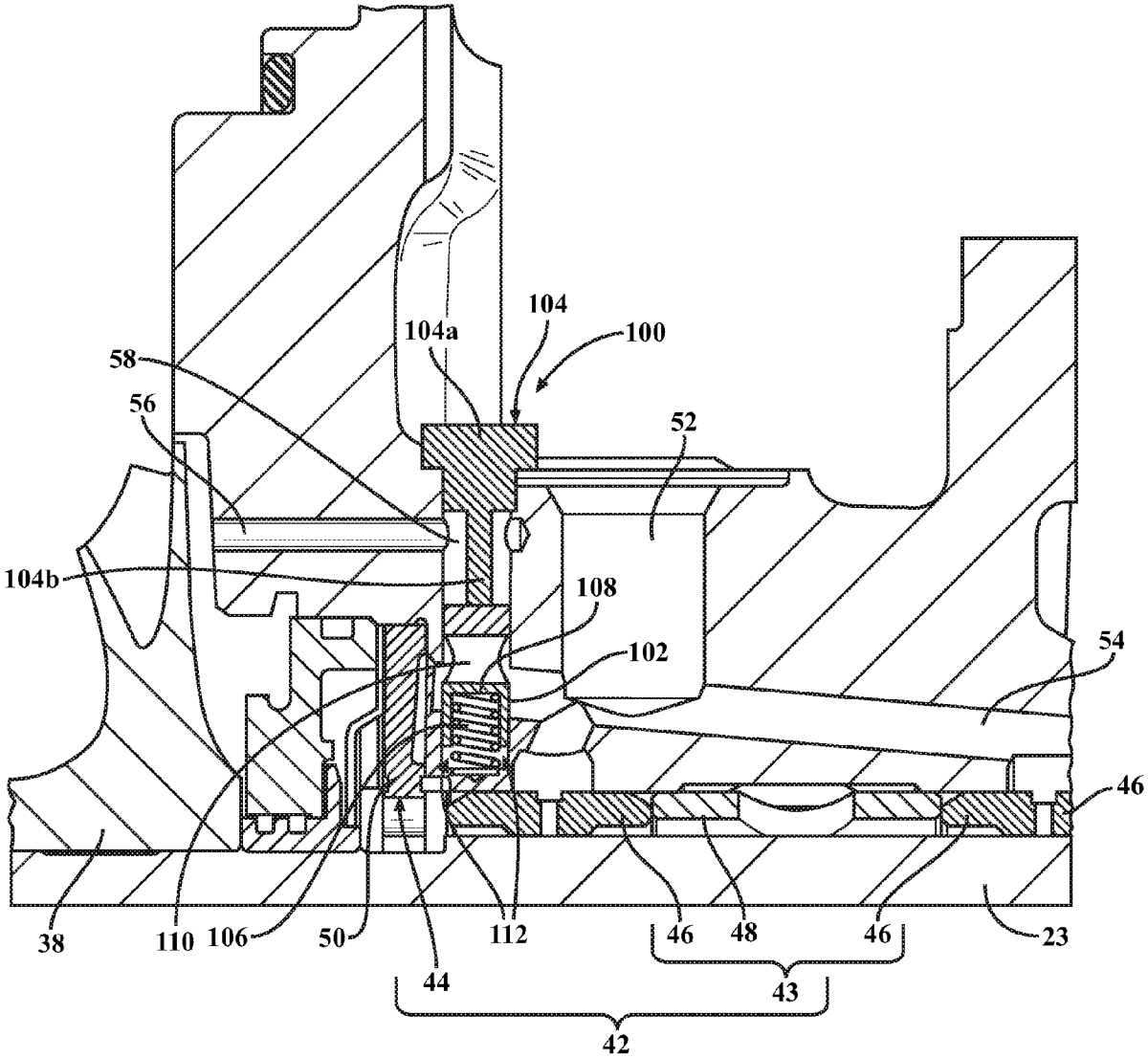
FIG. 2 is a cross-sectional view of the system for distributing oil flow and valve assembly.

As detailed in FIG. 2, the shaft (28) is supported by a bearing assembly (42). The beating assembly (42) comprises bearing components such as a journal bearing assembly (43) and a thrust bearing assembly (44) positioned about the shaft (28). The journal bearing assembly (43) includes a pair of journal bearings (46) spaced by a spacer (48). The pair of journal bearings (46) can be floating bearings (46) separated by the spacer (48). The thrust bearing assembly (44) includes a circular disk thrust bearing (50) disposed between a valve assembly (100) and the compressor wheel (38).

The bearing housing (16) includes an oil inlet (52), an oil channel (54) and an air channel (56). The oil channel (54) is fluidly connected to the oil inlet (52) and extends towards the floating journal bearings (46) and the circular disk thrust bearing (50). The air channel (56) extends from behind the compressor wheel (38) and is fluidly connected to the compressor wheel (38) and the valve assembly (100). The valve assembly (100) is positioned within an opening (58) formed in the bearing housing (16). Opening (58) fluidly communicates with the air channel (56) and oil channel (54). Alternately, the air channel (56) could fluidly communicate with the compressor air outlet (34) and the opening (58).

Oil distributed to the floating journal bearings (46) and/or the circular disk thrust bearing (50) is controlled by the valve assembly (100). The valve assembly (100) includes a valve member (102), a stop (104), and a spring (106). The valve member (102) is shaped to form a cut-out (108), and spring (106) is positioned within the cut-out (108). Valve member (102) also includes a through-port (110) for fluid communication of oil flow from the oil channel (54) through to the circular disk thrust bearing (50). Through-port (110) can have a circular inner diameter, a tapered inner diameter or an inner diameter containing converging sides. The stop (104) is a fixed stop and includes a head (104*a*) and stem (104*b*). The head (104*a*) is fixedly connected to the bearing housing (16) and the stem (104*b*) functions to restrain upward movement of the valve member (102).

In some aspects, the valve assembly (100) is operated using an actuator such as a pneumatic (not shown), hydraulic (not shown), or an electric actuator (shown in FIG. 3, and detailed more below). The actuator can be operatively connected to a portion of the compressor section (12) such as the compressor air outlet (34, shown in FIG. 1) or behind the compressor wheel (38). During operation of the turbocharger (10), and as the compressor wheel (38) spins, air is extracted through the air channel (56). At nearly the same time, oil is filtered through the oil inlet (52) to the oil channel (54). As pressure from behind the compressor wheel (38) is transmitted through the air channel (56), the air is forced into the opening (58) formed in the bearing housing (16). Air from the opening (58) acts upon valve member (102) causing the valve member (102) to move in a downward or upward direction, thereby compressing or expanding the spring (106), respectively. The valve assembly (100) can be used to control oil flow to a single bearing component such as the journal bearing assembly (43) or the thrust bearing assembly (44) in addition to or independent of the entire bearing assembly (42).

Under higher pressure conditions, air from the opening (58) ads upon valve member (102) causing the valve member (102) to move in a downward direction. Downward movement of the valve member (102) compresses the spring (106) forcing the spring (106) to make contact with a cavity (112) formed in the bearing housing (16). As the spring moves downwardly away from the stem (104*b*) of the stop (104), there is no contact of the stem (104*b*) with the valve member (102). The spring (106) is compressed such that through-port (110) is in fluid communication with oil channel (54) and oil is allowed to flow through to the circular disk thrust bearing (50). Contact with the cavity (112) causes the spring (106) to resists forces from the air pressure, adjusting the position of the valve member (102). Fluctuations in the air pressure can align the through-port (110) with the oil channel (54) wherein a maximum and/or a minimum amount of oil flows through. A maximum amount of oil flows through the oil channel (54) under higher pressure conditions where the spring (106) is fully compressed. A minimum amount of oil flows through the through-port (110) under lower pressure conditions. During lower pressure conditions, the air pressure through the air channel (56) is less. Hence, less pressure is imposed upon the valve member (102) and the spring (106). As such, resistance of the spring (106) is less, causing the spring (106) to expand. As the spring (106) expands, valve member (102) is allowed to move in an upward direction. Upward movement of the valve member (102) causes the valve member (102) to make contact with the stem (104*b*) of the stop (104). Contact of the valve member (102) with the stem (104*b*), halts and prevent any further upward movement of the valve member (102). As such, through-port (110) becomes misaligned with the oil channel (54) thereby limiting and/or restricting oil flow from the oil channel (54) through to the circular disk thrust bearing (50).

Figure 3:
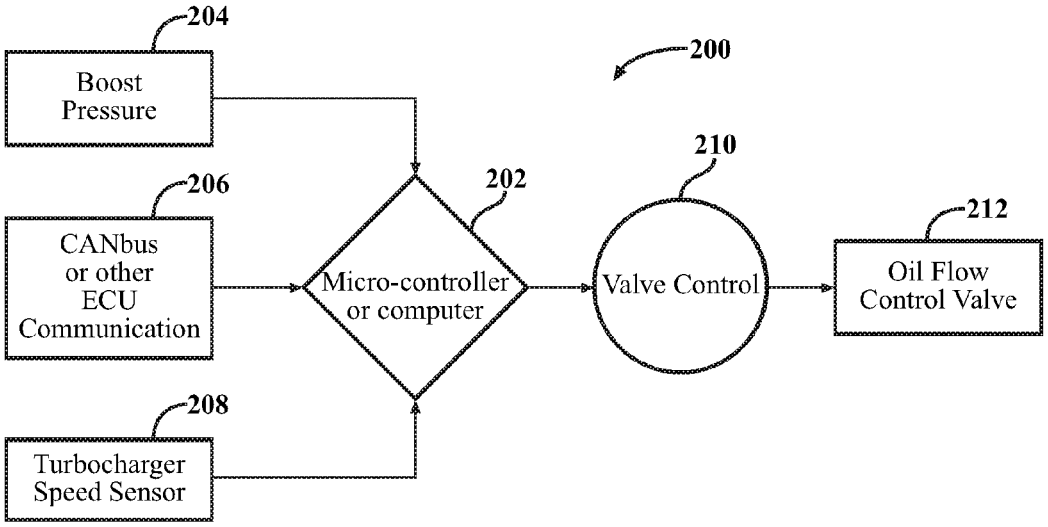
FIG. 3 is a schematic diagram of the electronic system for distributing oil flow.

FIG. 3 details a schematic diagram depicting an electronically controlled system (200) for distributing oil flow. A microcontroller or computer (202) receives an input from a combination of a boost pressure sensor (204); a controller area network system (CAN) or other ECU communications device (206); and/or a turbocharger speed sensor (208). The microcontroller or computer (202) applies the inputs received from the boost pressure sensor (204), controller area network system (CAN) or other ECU communications device (206), and/or a turbocharger speed sensor (208) to an algorithm or look-up table on a computer readable memory which generates a signal. The signal is sent to a valve controller (210) which activates the system for distributing oil flow (212). The electrically controlled system (200) for distributing oil flow can be controlled using feedback parameters such as turbocharger speed, compressor discharge pressure (or boost pressure), turbine inlet pressure (or backpressure), ambient temperature, engine speed, or engine torque.

Figure 4:
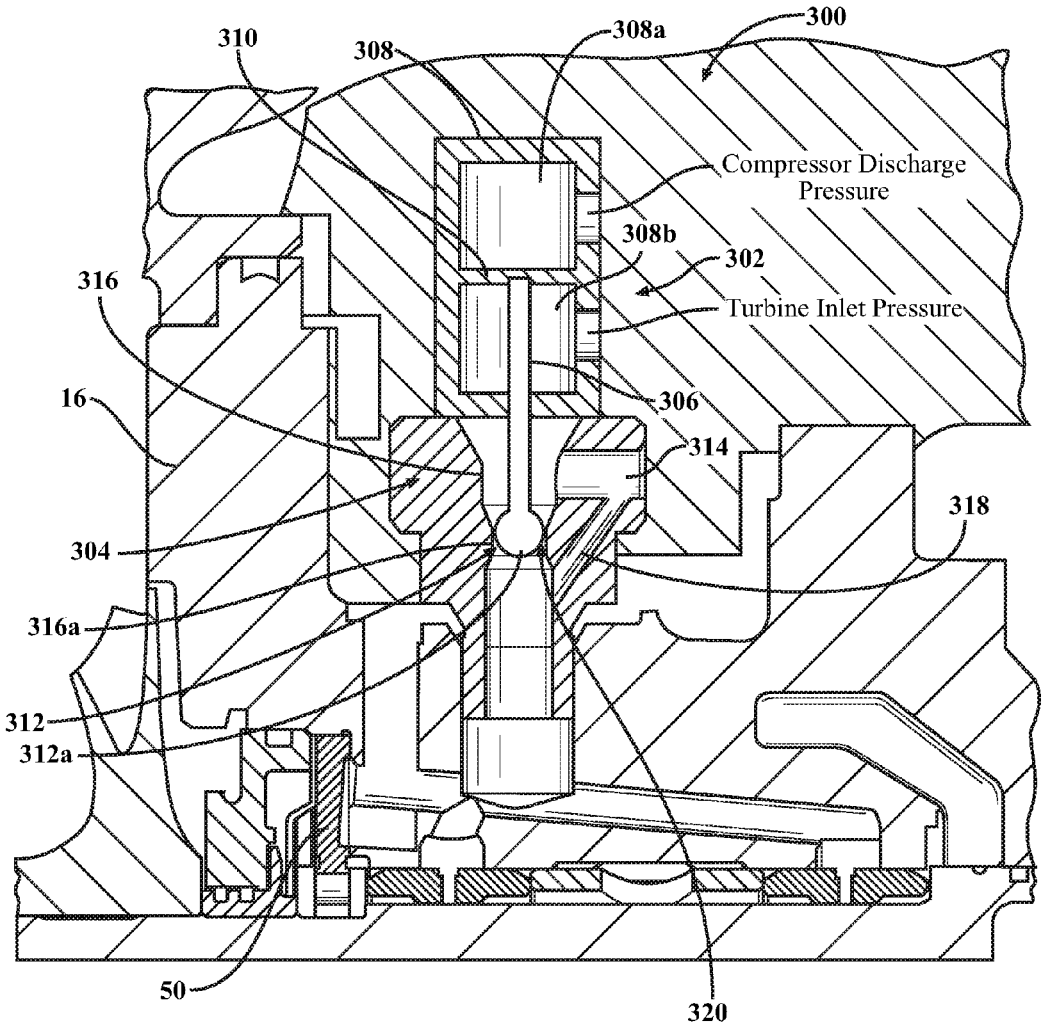
FIG. 4 is cross-sectional view of the oil flow control device

FIG. 4 details an oil flow control device (300) for metering oil flow to the bearing housing (16) and circular disk thrust bearing (50). The oil flow control device (300) comprises an actuating member (302) and a throttle (304). The oil flow control device (300) is retrofit into the bearing housing (16) and replaces the conventional oil inlet fitting. The actuating member (302) includes a rod (306) disposed within a housing (308). Rod (306) includes a piston (310) at a first end and a spherical valve (312) disposed at an opposing second end thereof. The spherical valve (312) includes a ball portion (312*a*) shaped to be positioned within the throttle (304). The throttle (304) includes an oil-in passage (314) and a shaped oil passage (316). The shaped oil passage (316) can be an hourglass shape and the ball portion is sized to be able to engage a protruding or contoured portion (316*a*) of the shaped oil passage (316). Housing (308) includes a first (308*a*) and a second (308*b*) positive pressure chamber. The first (308*a*) and second (308*b*) positive pressure chambers are divided by the piston (310). The first chamber (308*a*) communicates with the compressor discharge pressure and the second chamber (308*b*) communicates with the turbine inlet pressure.

In some aspects, the oil flow control device (300) is operated using an actuator such as a pneumatic (not shown), hydraulic (not shown), or an electric actuator. The actuator can be operatively connected to the oil flow control device (300) by any means known in the art. Operation of the oil flow control device (300) is based upon the turbocharger pressure differential (dP) or the pressure difference between the turbine inlet pressure and the compressor discharge pressure and by thrust loading on the circular disk thrust bearing (50). The oil flow control device (300) ensures that there is enough oil flow upon starting the engine. Oil flow is governed by the absolute value of displacement of the piston (310) pending the turbocharger pressure differential (dP) and loading on the circular disk thrust bearing (50).

During engine idle conditions, the load on the circular disk thrust bearing (50) is low and little oil flow is needed. Under these conditions, a desired scenario is to have a neutral turbocharger pressure differential (dP). When the turbocharger pressure differential (dP) is neutral, the compressor discharge pressure and the turbine inlet pressure into the, respective, first (308*a*) and second (308*b*) positive pressure chambers are approximately equal. As such, the approximately equivalent pressures within the first (308*a*) and second (308*b*) positive pressure chambers, counterbalances one another when acting upon the piston (310). This counterbalance of pressures acting upon the piston (310), causes the piston (310) to be disposed in a neutral position, approximately midway in the housing (308). When the piston (308) is disposed is a neutral position, the ball portion (312*a*) of the spherical valve (312) is disposed between the protruding or contoured portion (316*a*) of the shaped oil passage (316). In this position, the smallest or least amount of oil is permitted to flow through to the bearing housing (16) and circular disk thrust bearing (50).

During non-idle conditions, the load on the circular disk thrust bearing (50) is high and more oil flow is required. The oil flow control device (300) would provide more oil flow at high load conditions and less oil flow at low load conditions. When the pressure supplied to the first positive pressure chamber (308*a*) from the compressor discharge is more than the pressure supplied to the second positive pressure chamber (308*b*) from the turbine inlet pressure, the force of pressure from the first positive pressure chamber (308*a*) causes the piston (310) to move in a downward direction. A downward movement of the piston (310) pushes the ball portion (312*a*) of the spherical valve (312) beyond the protruding or contoured portion (316*a*) of the shaped oil passage (316), and a larger amount of oil is allowed to flow in comparison to what is allowed under a neutral turbocharger pressure differential (dP). When the pressure supplied to the first positive pressure chamber (308*a*) from the compressor discharge is less than the pressure supplied to the second positive pressure chamber (308*b*) from the turbine inlet pressure, the predominant pressure in the second positive pressure chamber (308*b*) acts upon the piston (310) causing the piston to move in an upward direction. In this scenario, the ball portion (312*a*) of the spherical valve (312) moves away from and can be positioned above the protruding or contoured portion (316*a*) of the shaped oil passage (316) thereby allowing a larger amount of oil to flow in comparison to oil flow under a neutral turbocharger pressure differential (dP).

Movement of the piston (310) can be adjusted according to various turbocharger designs. In general, the closer the ball portion (312*a*) of the spherical valve (312) is to the protruding or contoured portion (316*a*) of the shaped oil passage (316), smaller amounts of oil is permitted to flow through to the bearing housing (16) and the circular disk thrust bearing (50). Conversely, the farther the ball portion (312*a*) of the spherical valve (312) is from the protruding or contoured portion (316*a*) of the shaped oil passage (316), larger amounts of oil is permitted to flow through to the bearing housing (16) and the circular disk thrust bearing (50).

In some aspects, oil flow can be metered based on oil inlet temperature where a simple thermostat can be added to the oil flow control device (300). The thermostat (not shown) would open to maximize oil flow under cold start conditions. The thermostat (not shown) would close as oil inlet temperature increases thereby eliminating excessive oil flow under normal operating conditions. The thermostat (not shown) would replace the oil flow control device (300) or could be an additional feature.

In other aspects, a permanent bypass (318) could be used to deliver a specified amount of oil flow during idle or low thrust load conditions. The minimum oil flow can be controlled according to the diameter of the bypass (318). The smaller the diameter, lower amounts of oil flow. The larger the diameter, more oil flows. At low turbocharger speeds, oil flow would mostly be governed by the bypass diameter. As speed and/or thrust load increases, the oil flow control device (300) will open to allow more oil to flow to the bearing assembly (42).

Any combination of an oil flow control device (300) containing a piston (310)/ spherical valve (312) and ball portion (312*a*), thermostat (not shown) and/or bypass (318) can be used to control oil flow. The clearance (320) between the ball portion (312*a*) and the protruding or contoured portion (316*a*) of the shaped oil passage (316), the diameter of the bypass (318), and/or the spring rate of return of the pneumatic actuator (not shown), can be adjusted to customized turbocharger design requirements. Oil flow control results in effective bearing operation under high thrust loads, and decreases parasitic losses which occur from excessive oil flow during low thrust loads.

What is claimed is:

1. An exhaust gas turbocharger (10) comprising:

a turbine section (14) including a turbine housing (18) having an exhaust gas inlet (20), an exhaust gas outlet (22), a turbine volute (24), and a turbine wheel (26) configured to be disposed in fluid communication with the exhaust gas inlet (20) and the turbine volute (24);

a compressor section (12) including a compressor cover (30) configured to define a compressor air inlet (32), a compressor air outlet (34), and a compressor volute (36); and a compressor wheel (38) configured to be disposed in fluid communication with the compressor air inlet (32) and the compressor volute (36);

a bearing housing (16) configured to be disposed between an fluidly connected to the turbine section (14) and the compressor section (12), the bearing housing (16) including an oil inlet (52) configured to be fluidly connected to an oil channel (54), and a bearing assembly (42) for rotatably supporting a shaft configured to be connected to the turbine wheel (26) and the compressor wheel (38); and an oil flow means configured to be connected to the bearing housing (16) for controlling and metering oil flow to the bearing assembly (42), wherein the valve assembly comprises a stop (104) configured to be connected to a valve member (102), and a spring (106) configured to be positioned within the valve member (102), wherein the stop (104) further comprises a head (104*a*) having a stem (104*b*) configured to extend therefrom, the head (104*a*) is configured to be fixedly connected to the bearing housing (16) and the stem (104*b*) is configured to engage the valve member (102) such that oil flows to a single bearing component in addition to the bearing assembly (42).

2. The exhaust gas turbocharger of claim 1 wherein the oil flow control means comprises a valve assembly (100) configured to be positioned within an opening (58) formed in the bearing housing (16) and an air channel (56) configured to be in fluid communication with the opening (58).

3. The exhaust gas turbocharger of claim 1 wherein the oil flow control means comprises an oil flow control device (300) configured to be retrofit into the oil inlet (52) of the bearing housing (16), such that a turbocharger pressure differential (dP) controls and meters oil flow; the oil flow control device (300) further comprising an actuating member (302) and a throttle (304).

4. The exhaust gas turbocharger of claim 1 wherein the valve member (102) further comprises a cut-out (108) such that the spring (106) is configured to be positioned within the cut-out (108), and a through-port (110) configured to be in fluid communication with the bearing assembly (42).

5. The exhaust gas turbocharger of claim 1 wherein the stop (104) further comprises a head (104*a*) having a stem (104*b*) configured to extend therefrom, the head (104*a*) is configured to be fixedly connected to the bearing housing (16) and the stem (104*b*) is configured to engage the valve member (102) such that oil flows to a single bearing component independently of the bearing assembly (42).

6. An exhaust gas turbocharger (10) comprising:

a turbine section (14) including a turbine housing (18) having an exhaust gas inlet (20), an exhaust gas outlet (22), a turbine volute (24), and a turbine wheel (26) configured to be disposed in fluid communication with the exhaust gas inlet (20) and the turbine volute (24);

a compressor section (12) including a compressor cover (30) configured to define a compressor air inlet (32), a compressor air outlet (34), and a compressor volute (36); and a compressor wheel (38) configured to be disposed in fluid communication with the compressor air inlet (32) and the compressor volute (36);

a bearing housing (16) configured to be disposed between an fluidly connected to the turbine section (14) and the compressor section (12), the bearing housing (16) including an oil inlet (52) configured to be fluidly connected to an oil channel (54), and a bearing assembly (42) for rotatably supporting a shaft configured to be connected to the turbine wheel (26) and the compressor wheel (38); and an oil flow means configured to be connected to the bearing housing (16) for controlling and metering oil flow to the bearing assembly (42), wherein the oil flow control means comprises an oil flow control device (300) configured to be retrofit into the oil inlet (52) of the bearing housing (16), such that a turbocharger pressure differential (dP) controls and meters oil flow; the oil flow control device (300) further comprising an actuating member (302) and a throttle (304), wherein the actuating member (302) further comprises a housing (308) having a first (308*a*) and a second (308*b*) positive pressure chamber, the first positive pressure chamber (308*a*) is configured to be connected to a compressor discharge pressure and the second positive pressure chamber (308*b*) is configured to be connected to the turbine inlet pressure.

7. The exhaust gas turbocharger of claim 6 wherein the actuating member (302) further comprises a rod (306) having a piston (310) configured to be connected at a first end thereof and a spherical valve (312) configured to be disposed at an opposing second end thereof; and the throttle (304) further comprises an oil-in passage (314) and a shaped oil passage (316) including a protruding portion (316*a*); the rod (306) is configured to be disposed within the housing (308) and the spherical valve (312) is configured to be disposed within the shaped oil passage (316).

8. The exhaust gas turbocharger of claim 7 wherein the spherical valve (312) is configured to engage the protruding portion (316*a*) of the shaped oil passage (316) to permit a small amount of oil to flow through to the bearing housing (16) and the bearing assembly (42).

9. The exhaust gas turbocharger of claim 7 wherein the spherical valve (312) is configured to extend beyond the protruding portion (316*a*) of the shaped oil passage (316) to permit a large amount of oil to flow through to the bearing housing (16) and the bearing assembly (42).

10. The exhaust gas turbocharger of claim 7 wherein the oil flow control device (300) further comprises a permanent bypass (318) configured to be connected to the oil-in passage (314) and a shaped oil passage (316).

11. The exhaust gas turbocharger of claim 7 wherein the throttle (304) of the oil flow control device (300) further comprises a thermostat configured to be connected to the oil-in passage (314) and a shaped oil passage (316).

* * * * *